US011433268B2

(12) United States Patent
Kupferman

(10) Patent No.: US 11,433,268 B2
(45) Date of Patent: Sep. 6, 2022

(54) FLEXIBLE EXERCISE AND REHABILITATION BAR

(71) Applicant: Scott J. Kupferman, New York, NY (US)

(72) Inventor: Scott J. Kupferman, New York, NY (US)

( * ) Notice: Subject to any disclaimer, the term of this patent is extended or adjusted under 35 U.S.C. 154(b) by 20 days.

(21) Appl. No.: 16/943,095

(22) Filed: Jul. 30, 2020

(65) Prior Publication Data

US 2022/0032107 A1 Feb. 3, 2022

(51) Int. Cl.

*A63B 21/045* (2006.01)
*A63B 21/02* (2006.01)
*A63B 21/00* (2006.01)

(52) U.S. Cl.

CPC ..... *A63B 21/045* (2013.01); *A63B 21/00043* (2013.01); *A63B 21/00069* (2013.01); *A63B 21/028* (2013.01); *A63B 21/4035* (2015.10)

(58) Field of Classification Search

CPC ..... A63B 21/045; A63B 21/028; A63B 21/00043; A63B 21/00069; A63B 21/4035

See application file for complete search history.

(56) References Cited

U.S. PATENT DOCUMENTS 3,510,130 A * 5/1970 Ferdinand ..... A63B 21/00043 482/46
3,746,336 A * 7/1973 Tanimoto ..... A63B 21/0004 482/46
5,004,226 A * 4/1991 Brown, Jr. ..... A63B 21/00043 482/126
6,106,438 A * 8/2000 Dean ..... A63B 23/14 127/45
6,379,286 B1 * 4/2002 Scopino ..... A63B 15/00 482/93
6,872,174 B2 * 3/2005 Benach ..... A63B 21/00043 482/121
2004/0132592 A1 * 7/2004 Yu ..... A63B 21/0004 482/126
2005/0079962 A1 * 4/2005 Brown, Jr. ..... A63B 21/026 482/121
2006/0211551 A1 * 9/2006 Mandell ..... A63B 21/00185 482/121
2018/0001132 A1 * 1/2018 Brown, Jr. ..... A63B 21/027
2019/0314672 A1 * 10/2019 Lagree ..... A63B 21/023
2020/0094103 A1 * 3/2020 Wallander ..... A63B 23/12
2021/0354000 A1 * 11/2021 Alba ..... A63B 21/018

* cited by examiner

*Primary Examiner* — Andrew S Lo
(74) *Attorney, Agent, or Firm* — Renner, Kenner, Greive, Bobak, Taylor & Weber

(57) ABSTRACT

An exercise and rehabilitation bar including a flexing bar, at least one resistance insert, and at least one handle. The flexing bar has a first end, a second end, and a cavity running from the first end to the second end. The at least one resistance insert is removably carried within the cavity of the flexing bar and the at least one handle is removably securable to either the first or second end of the flexing bar.

9 Claims, 4 Drawing Sheets

FLEXIBLE EXERCISE AND REHABILITATION BAR

FIELD OF THE INVENTION

The present invention generally relates to the field of exercise and physical rehabilitation equipment. Specifically, the present invention relates to a flexible exercise and rehabilitation bar that includes at least one handle, a flexing bar, and at least one resistance insert. More specifically, the at least one resistance insert is insertable within a cavity of the flexing bar, and the at least one handle can be removably attached to an outside of the flexing bar.

BACKGROUND OF THE INVENTION

Regular exercise is typically recommended to improve or maintain health. Far too often, however, too great of an emphasis is placed on cardiovascular activities such as cycling, running, or team sports such as basketball. While cardiovascular activities are important to improving and sustaining personal health, so is strength training, or resistance training, which is frequently overlooked, especially in instances where strength training has been prescribed as part of a rehabilitation program. In fact, resistance training, most typically associated with increasing strength, is also known to aid in the prevention of injuries.

To meet strength training and conditioning needs, consumers will often purchase expensive and elaborate gym equipment, which is typically not portable, or commit to lengthy gym memberships. Taking into consideration the problems with the aforementioned options, portable exercise equipment has been developed to improve muscle mass and strength for home and on the go.

It has long been recognized that it is possible to strengthen the muscles and tendons of a human hand by undergoing resistance exercises over time. It has been found especially desirable to provide a device which offers adjustable flexion and extension resistance for the fingers and dynamic twisting, bending, and flexing motions for the wrists and forearms in order to provide a suitable degree of functional exercise to the joints in motion. In the instance of post traumatic recovery, it is important to provide progressive resistance during the period when the muscles and tendons of the hand, wrist and forearms are recovering from an injury. Finger and wrist exercisers have also been suggested which would provide conditioning for a healthy hand, such as devices being used by musicians, dentists, athletes or other persons requiring a high degree of manual dexterity and strength in their professions.

Moreover, a proliferation of computer keyboards in offices and homes has given rise to a dramatic increase in repetitive strain injuries such as nerve entrapments, tendon problems and muscle strain, Such injuries are commonly perceived as persistent aches or soreness in the forearms and wrists, or pain that may be felt from the shoulder to the fingertips.

One of the numerous types of repetitive stress injuries is known as carpal tunnel syndrome. This refers to compression of the median nerve as a result of the swelling of tendons and sheaths, or repeated bending of the wrist, as can occur in susceptible individuals as a result of protracted use of a computer keyboard. The position in which the hands and fingers are placed to use a keyboard typically keeps the associated muscles in flexion which may cause the shooting pain and numbness in the fingers. Wrist rests and other devices are commonly used to support the wrists when there is a pause during typing. However, such devices, while relieving stress on muscles and joints in some circumstances, do nothing to functionally strengthen or rehabilitate the muscles and joints to avoid injury, or to rehabilitate from prior injury. Moreover, the advantageous aspects of wrist rests may depend on the way the user's wrist is positioned. Misuse of a wrist rest may in fact cause more, harm than good, increasing the potential for repetitive stress injuries.

Although there are many devices in the prior art for exercising the fingers, these prior devices do a poor job of integrating dynamic motion exercises for all of the muscles, tendons of the fingers, hands, wrists, and forearms. In order to strengthen the finger muscles and joints of the hand to avoid carpal tunnel injury or repetitive strain injuries (RSI), it is desirable to strengthen the extensor muscles and tendons to prevent those muscles from becoming overpowered by flexor muscles as well as becoming injured by repetitive strain. While various devices have been proposed which exercise the extensor muscles, such devices only focus on isolation movements for the fingers to address the causes of repetitive strain injuries.

Another common issue is what is known as "tennis elbow". "Tennis elbow," in its strictest meaning, is the common term used to describe lateral epicondylitis. This is a tendonitis of the extensor carpi radialis brevis, which attaches to the lateral epicondyle of the humerus. It may be caused by a sudden injury or by repetitive use of the arm. It may involve micro tears in the tendons that lead to a hyper vascular condition resulting in pain. The pain is usually worse with strong gripping with the elbow in an extended position, as in a tennis back-hand stroke, but this problem can occur in golf and other sports as well as with repetitive use of tools.

It has been reported that nearly half of all recreational golf and tennis players age 30 or older have suffered from tennis elbow symptoms, which may arise from tennis backhands and serves and repetitive swings of a golf club. Incidence of the malady has increased with the introduction of new tennis technologies, especially longer racquets and tighter stringing which increases stress on the lateral and medial epicondyle more easily which overloads the small extensor tendons which are inherently weak by design. Tennis elbow can arise not only from sports and working with tools, but also from simply picking up an object with the arm extended.

Lateral epicondylitis refers to inflammation of the tendons that attach the extensor muscles of the forearm to the outer portion of the bony prominence of the elbow, which is the lateral epicondyle. The resulting pain tends to be felt in the outer portions of the elbow and forearm. Tennis elbow pain coming, from the inner portion of the elbow may be designated as medial epicondylitis wherein tendons of the extensor muscles that are attached to the medial epicondyle are inflamed.

All sorts of treatments of tennis elbow have been suggested. These range from internal and external medications, heat, cold, ultrasound, to surgery. Many kinds of devices have been sold or described, including braces, magnets, slings, stretching devices. But many devices are difficult to use and do not fully address the causes of the problem.

There is accordingly a need for a device which can provide more functional upper extremity movement patterns that include forceful gripping as well as reverse grip finger extension exercise features to more comprehensively address the conditioning of the thumb, fingers, wrists and forearms leading to the elbows in a natural path of motion.

SUMMARY OF THE INVENTION

In a first embodiment, the present invention provides an exercise and rehabilitation bar comprising: a flexing bar having a first end, a second end, and a cavity running from the first end to the second end; at least one resistance insert; and at least one handle wherein, the at least one resistance insert is removably carried within the cavity of the flexing bar and wherein the at least one handle is removably securable to either the first end or second end of said flexing bar Another embodiment of the present invention provides an exercise and rehabilitation bar as in any embodiment above wherein two handles are included, and wherein a first handle is removably securable to the first end of the flexing bar and a second handle is removably securable to the second end of the flexing bar.

Another embodiment of the present invention provides an exercise and rehabilitation bar as, in any embodiment above wherein each handle of the two handles includes a hand strap removably securable to an exterior of each handle of the two handles, a finger band removably securable to the exterior of each handle of the two handles, and a stop piece located within an interior of each handle of the two handles.

Another embodiment of the present invention provides an exercise and rehabilitation bar as in any embodiment above wherein the first handle includes a male connector located on an exterior of the first handle and wherein the second handle includes, a female connector located on an exterior of the second handle.

Another embodiment of the present invention provides an exercise and rehabilitation bar as in any embodiment above wherein the flexing bar has a contoured exterior surface and each handle of the two handles has a contoured interior surface that is congruent with the contoured exterior surface of the flexing bar.

Another embodiment of the present invention provides an exercise and rehabilitation bar as in any embodiment above wherein when the first handle is removably secured to the first end of the flexing bar, said first end of the flexing bar abuts the stop piece of the first handle; and wherein when the second handle is removably secured to the second end of the flexing bar, said second end of the flexing bar abuts the stop piece of the second handle.

Another embodiment of the present invention provides an exercise and rehabilitation bar as in any embodiment above wherein a plurality of resistance inserts is including wherein each resistance bar requires a different amount of force to bend into a U-shape.

Another embodiment of the present invention provides an exercise and rehabilitation bar as in any embodiment above wherein the flexing bar has a contoured interior surface and each resistance insert of the plurality of resistance inserts has a contoured exterior surface that is congruent with the contoured interior surface of the flexing bar.

Another embodiment of the present invention provides an exercise and rehabilitation bar comprising: a flexing bar having a first end, a second end, and a cavity running from the first end to the second end; and at least one resistance insert; wherein the at least one resistance insert is removably carried within the cavity of the flexing bar.

Another embodiment of the present invention provides an exercise and rehabilitation bar as in any embodiment above wherein a plurality of resistance inserts is including wherein each resistance bar requires a different amount of force to bend into a U-shape.

Another embodiment of the present invention provides an exercise and rehabilitation bar as in any embodiment above wherein the flexing bar has a contoured interior surface and each resistance insert of the plurality of resistance inserts has a contoured exterior surface that is congruent with the contoured interior surface of the flexing bar.

Another embodiment of the present invention provides an exercise and rehabilitation system comprising: a first handle including a male connector located on an exterior thereof; and a second handle including a female connector located on an exterior thereof, wherein said male connector of said first handle is removably securable within said female connector of said second handle.

Another embodiment of the present invention provides an exercise and rehabilitation system wherein said first and second handle each also include a hand strap removably securable to an exterior of each of said first and second handles, a finger band removably securable to the exterior of each of said first and second handles, and a stop piece located within an interior of each of said first and second handles.

Another embodiment of the present invention provides an exercise and rehabilitation system wherein said first and second handle each also include a pair of male connectors and a pair of female connectors located on the exterior of each of said first and second handles, wherein the hand strap of each handle of the first and second handles includes a pair of male connectors, wherein the finger band of each handle of the first and second handles includes a pair of female connectors, wherein each hand strap is removable secured to each of the first and second handles through the pair of female connectors, and wherein each finger band is removable secured to each of the first and second handles through the pair of male connectors.

BRIEF DESCRIPTION OF THE DRAWINGS

For a more complete understanding of the features and advantages of the present invention, reference is now made to the detailed description of the invention along with the accompanying figures in which.

DETAILED DESCRIPTION OF ILLUSTRATIVE EMBODIMENTS

Figure 1:
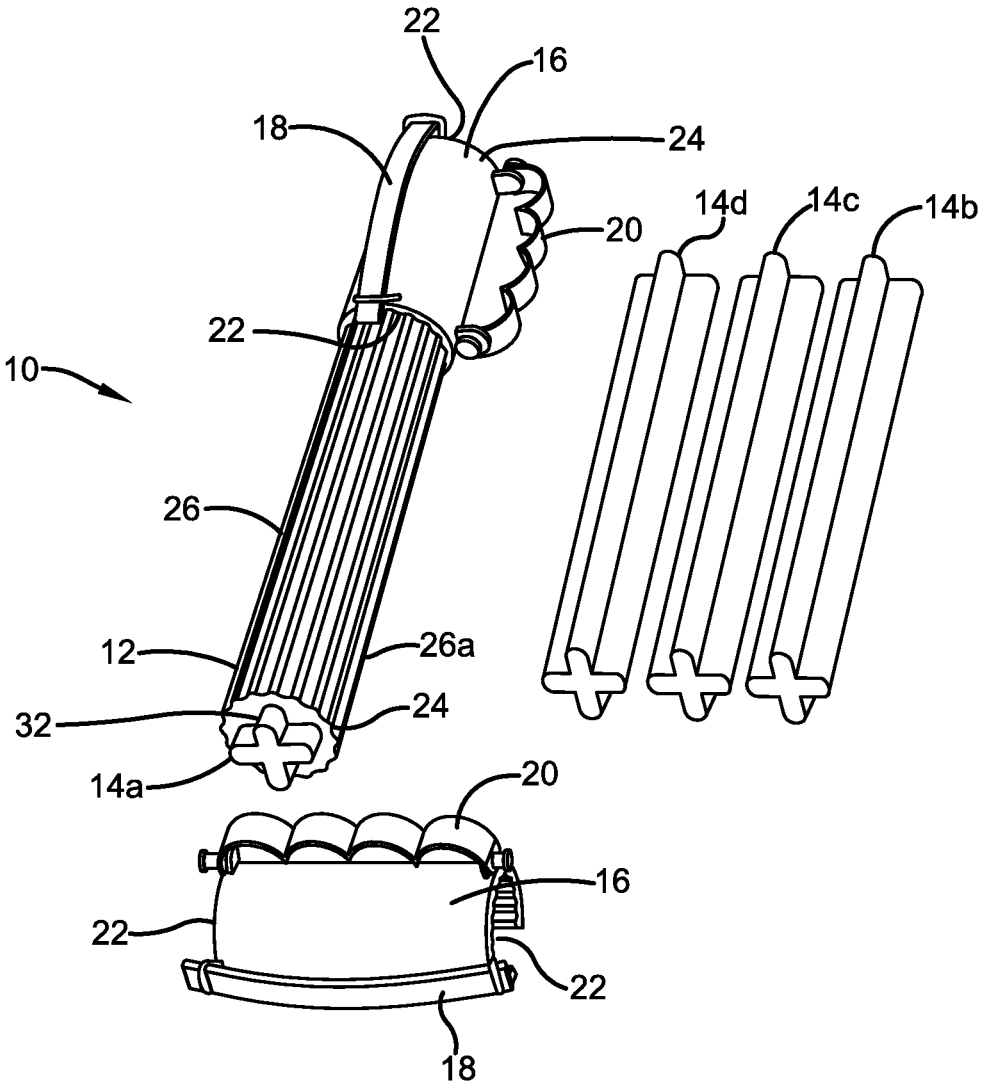
FIG. 1 is a perspective view of the exercise and rehabilitation bar of the present invention including a plurality of resistance inserts.

An exercise and rehabilitation bar of the present invention is generally indicated by the numeral 10, Bar 10 includes a flexing bar 12, at least one resistance insert 14, and at least one handle 16. In one or more embodiments of the present invention, there will be a plurality of resistance inserts 14, all providing different levels of resistance which will be explained later in more detail. In one or more embodiments, of the present invention, there will be two handles 16. Each handle 16 includes a hand strap 18, a finger band 20, and two open ends 22.

In one or more embodiments of the present invention, flexing bar 12 is made from a material selected from the group consisting of natural rubbers or thermoplastic elastomers. In one or more embodiments of the present invention, the at least one resistance insert 14 is made from a material selected from the group consisting of natural rubbers or thermoplastic elastomers. In one or more embodiments of the present invention, the at least one handle is made from the material selected from polypropylene, natural rubbers or thermoplastic elastomers.

Figure 2:
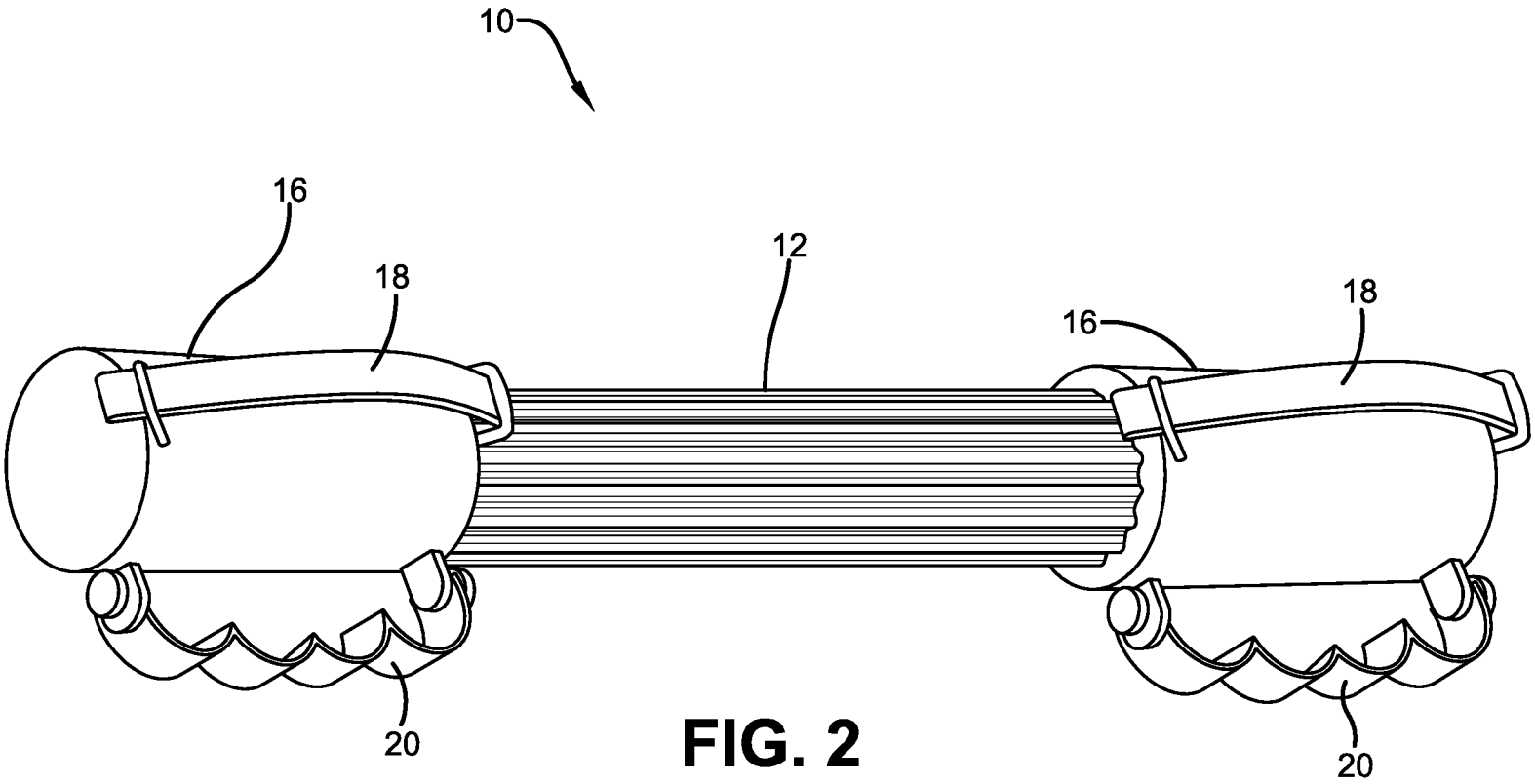
FIG. 2 is a perspective view of the exercise and rehabilitation bar of FIG. 1 with handles removably secured to both ends.
Figure 3:
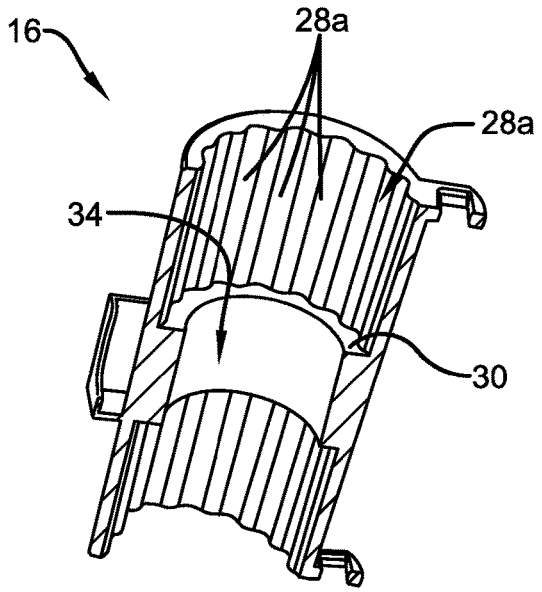
FIG. 3 is a perspective view showing an interior of a handle of the present invention.

As shown in FIGS. 1 and 2, the handles 16 are removably securable on the ends 24 of flexing bar 12. To secure a handle 16 to flexing bar 12, an end 24 of flexing bar 12 is slide into an open end 22 of the handle 16. As shown in FIG. 3, each handle 16 includes a stop piece 30 that will come into contact with an end 24 of the flexing bar 12 and will therefore stop the handle 16 from sliding much further past a position adjacent the ends 24 of the flexing bar 12. As shown in FIG. 1, the outer surface 26 of the flexing bar 12 is textured with ribs 26*a* and the inner surface 28 of each handle 16 is textured with complementary/congruent ridges 28*a* (as best seen in FIGS. 3, 4*a*, 4*b*, and 5 such that the ribs 26*a* will create a frictional fit with the ridges 28*a* and allow for the handles 16 to be removably secured onto the flexing bar 12.

Exercise and rehabilitation bar 10 allows for a user to grip either end 24 of bar 10 to strengthen the upper extremities by engaging the flexor muscles of the palms and forearms. A user would grip an end 24 and perform twisting, bending, and flexing movements by bending the arm at the elbow and or elevating the arm from the shoulder joint. Attaching a handle 16 to bar 10 enables the same integrated functional upper extremity movements, only this time utilizing the fingers in an open position under tension. Utilization of the hand strap 18 and, finger band 20 of each handle 16 activates the extensor chain of the forearm leading to the back of the hands and fingers. This provides dynamic rebalancing needed to prevent the flexor region from shortening and becoming overdeveloped. By sliding a hand under the back of hand strap 18 and the fingers under the finger band 20, the user can then open their hands to engage the finger extensor muscles and tendons from the elbows down the back of the forearm to the back of the hand providing integrated functional movements.

Figure 6:
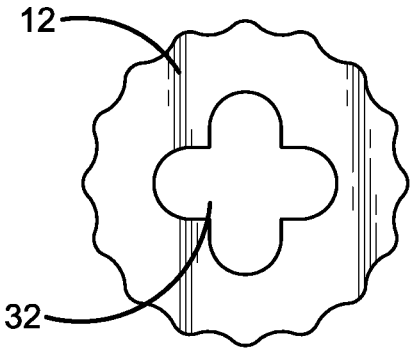
FIG. 6 is a cross-sectional view of the flexing bar of the present invention taken along line A-A in FIG. 2.

As also shown in FIG. 1, a resistance insert 14*a* is placed within flexing bar 12 and is therefore carried by flexing bar 12. As shown in FIG. 6, flexing bar 12 contains a cavity 32 that runs the length of the flexing bar 12. Cavity 32 has a complementary/congruent shape to the shape of the resistance inserts 14 and therefore, cavity 32 of the flexing bar 12 can receive any resistance insert 14 having the same complementary/congruent shape. The present invention is not limited as to the shape of the resistance inserts 14 and cavity 32. As shown in FIGS. 1 and 6, the resistance inserts 14 and cavity 32 have a "plus-sign" shape. As shown in FIG. 3, each handle 16 will also include an aperture 34 that will allow for a resistance insert to be changed without baying to remove handle 16 if handle 16 is secured to the flexing bar 12.

Figure 4A:
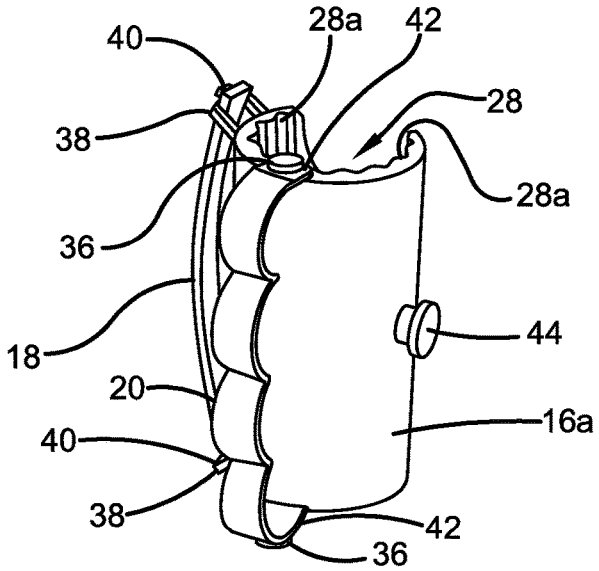
FIG. 4*a* is a perspective view showing a handle of the present invention including a side male connector.
Figure 4B:
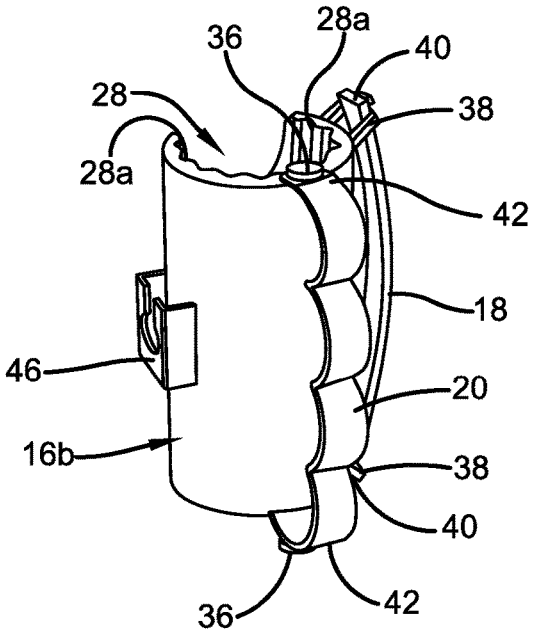
FIG. 4*b* is a perspective view showing a handle of the present invention including a side female connector.

As shown in FIGS. 4*a* and 4*b*, each handle 16 also includes a pair of male connectors 36 and a pair of female connectors 38 adjacent the open ends 22 of handle 16. In one embodiment of the present invention, the hand strap 18 has a pair of male connectors 40 and the finger band 20 has a pair of female connectors 42 such that the hand strap 18 is attached to handle 16 through use of the pair of female connectors 38 and the finger band 20 is attached to handle 16 through the use of the pair of male connectors 40. In other embodiments, the hand strap 18 can be secured to each handle 16 through use of female connectors, and the finger band 20 can be secured to each handle 16 through use of male connectors.

Figure 5:
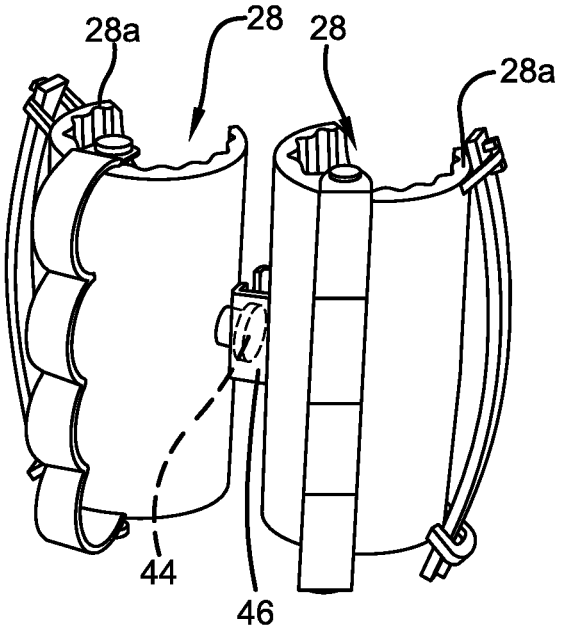
FIG. 5 is a perspective view showing the handle of FIG. 4*a* removable secured to the handle of FIG. 4*b*.

In one embodiment, the exercise and rehabilitation bar 10 of the present invention includes a pair of handles 16*a* and 16*b*. Handle 16*a* additionally includes a side male connector 44 and handle 16*b* additionally includes a side female connector 46. In this embodiment, the side male connector 44 of handle 16*a* can be secured in the female connector 46 of handle 16*b* so as to secure the two handles 16*a* and 16*b* together, such as shown in FIG. 5.

In a further embodiment of the present invention, the pair of handles 16*a* and 16*b* can be utilized as a separate, handheld rehabilitation and exercise system. As shown in FIG. 5, the side male connector 44 of handle 16*a* can be secured in the female connector 46 of handle 16*b* so as to secure the two handles 16*a* and 16*b* together. When handles 16*a* and 16*b* are secured together, a user can grip and rotate handles 16*a* and 16*b* with the hand strap 18 and finger band 20 of each handle 16 and can perform, various push and pull finger extensor exercises to strengthen the forearms, hands, and fingers of the user. When handles 16*a* and 16*b* are connected to each other, a user can then slide their hands under the hand straps 18 and then the user can place their fingers under the finger bands 20 while then rotating the handles 16*a* and 16*b* while extending their fingers on one or both hands.

In one or more embodiments of the present invention, the exercise and rehabilitation bar 10 includes a plurality of resistance inserts 14. In one embodiment, such as shown in FIG. 1, exercise and rehabilitation bar 10 includes four resistance inserts 14*a*, 14*b*, 14*c*, and 14*d* with each resistance insert 14 requiring a different amount of force to bend the resistance insert into a U-shape. In one embodiment, resistance insert 14*a* requires between 4 and 8 pounds to bend, in other embodiments between 4.5 and 7.5 pounds to bend, and, in yet other embodiments between 5 and 7 pounds to bend. In one embodiment, resistance insert 14*b* requires between 8 and 12 pounds to bend, in other embodiments between 8.5 and 11.5 pounds to bend, and in yet other embodiments between 9 and 11 pounds to bend. In one embodiment, resistance insert 14*c* requires between 13 and 17 pounds to bend, in other embodiments between 13.5 and 16.5 pounds to bend, and in yet other embodiments between 14 and 16 pounds to bend. In one embodiment, resistance insert 14*d* requires between 23 and 27 pounds to bend, in other embodiments between 23.5 and 26.5 pounds to bend, and in yet other embodiments between 24 and 26 pounds to bend.

In light of the foregoing, it should be appreciated that the present invention significantly advances the art by providing an exercise and rehabilitation bar that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. An exercise and rehabilitation bar comprising:

a. a flexing bar having a first end, a second end, and a cavity running from the first end to the second end;

b. at least one resistance insert; and c. two handles, wherein a first handle is removably securable to the first end of the flexing bar and a second handle is removably securable to the second end of the flexing bar, and wherein each handle of the two handles includes a hand strap attached to an exterior of each handle of the two handles, a finger band removably securable to the exterior of each handle of the two handles, and a stop piece located within an interior of each handle of the two handles;

wherein the at least one resistance insert is removably carried within the cavity of the flexing bar and wherein the at least one handle is removably securable to either the first end or second end of said flexing bar.

2. The exercise and rehabilitation bar of claim 1 wherein the flexing bar has a contoured exterior surface and each handle of the two handles has a contoured interior surface that is congruent with the contoured exterior surface of the flexing bar.

3. The exercise and rehabilitation bar of claim 2 wherein when the first handle is removably secured to the first end of the flexing bar, said first end of the flexing bar abuts the stop piece of the first handle; and wherein when the second handle is removably secured to the second end of the flexing bar, said second end of the flexing bar abuts the stop piece of the second handle.

4. An exercise and rehabilitation bar comprising:

a. a flexing bar having a first end, a second end, and a cavity running from the first end to the second end;

b. at least one resistance insert; and c. two handles, wherein a first handle is removable securable to the first end of the flexing bar and a second handle is removably securable to the second end of the flexing bar, and wherein the first handle includes a male connector located on an exterior of the first handle and wherein the second handle includes a female connector located on an exterior of the second handle;

wherein the at least one resistance insert is removably carried within the cavity of the flexing bar and wherein the at least one handle is removably securable to either the first end or second end of said flexing bar.

5. The exercise and rehabilitation bar of claim 4, wherein the flexing bar has a contoured exterior surface and each handle of the two handles has a contoured interior surface that is congruent with the contoured exterior surface of the flexing bar.

6. The exercise and rehabilitation bar of claim 4, including a plurality of resistance inserts each requiring a different amount of force to bend into a U-shape.

7. The exercise and rehabilitation bar of claim 6, wherein the flexing bar has a contoured interior surface and each resistance insert of the plurality of resistance inserts has a contoured exterior surface that is congruent with the contoured interior surface of the flexing bar.

8. An exercise and rehabilitation bar comprising:

a. a flexing bar having a first end, a second end, and a cavity running from the first end to the second end;

b. a plurality of resistance inserts each requiring a different amount of force to bend into a U-shape; and c. at least one handle;

wherein at least one resistance insert of said plurality of resistance inserts is removable carried within the cavity of the flexing bar, wherein the at least one handle is removably securable to either the first end or second end of said flexing bar, and wherein the flexing bar has a contoured interior surface and each resistance insert of the plurality of resistance inserts has a contoured exterior surface that is congruent with the contoured interior surface of the flexing bar.

9. The exercise and rehabilitation bar of claim 8, wherein the flexing bar has a contoured exterior surface and each handle of the two handles has a contoured interior surface that is congruent with the contoured exterior surface of the flexing bar.

* * * * *